US011022145B2

(12) United States Patent
Maliniak et al.

(10) Patent No.: US 11,022,145 B2
(45) Date of Patent: Jun. 1, 2021

(54) BUSHING ARRANGED BETWEEN A BODY AND A SHAFT, AND CONNECTED TO THE SHAFT

(71) Applicant: United Technologies Corporation, Farmington, CT (US)

(72) Inventors: David Maliniak, Guilford, CT (US); Nathan F. Champion, Enfield, CT (US); Kenneth A. Frisk, West Hartford, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 197 days.

(21) Appl. No.: 16/105,336

(22) Filed: Aug. 20, 2018

(65) Prior Publication Data

US 2018/0347587 A1 Dec. 6, 2018

Related U.S. Application Data

(62) Division of application No. 14/107,719, filed on Dec. 16, 2013, now Pat. No. 10,125,789.

(60) Provisional application No. 61/765,439, filed on Feb. 15, 2013.

(51) Int. Cl.
*F04D 29/56* (2006.01)
*F01D 17/16* (2006.01)

(52) U.S. Cl.
CPC ..... *F04D 29/563* (2013.01); *F01D 17/162* (2013.01); *F05D 2250/14* (2013.01); *F05D 2250/73* (2013.01)

(58) Field of Classification Search
CPC ..... F01D 17/162; F04D 29/563
USPC ..... 415/160
See application file for complete search history.

(56) References Cited

U.S. PATENT DOCUMENTS

| | | | | |
|---|---|---|---|---|
| 3,946,554 | A | 3/1976 | Neumann | |
| 4,498,790 | A | 2/1985 | Fisher | |
| 4,585,390 | A * | 4/1986 | Pirtle | F01D 9/042 415/160 |
| 4,604,030 | A | 8/1986 | Naudet | |
| 4,706,354 | A | 11/1987 | Naudet et al. | |
| 4,792,277 | A | 12/1988 | Dittberner, Jr. et al. | |
| 4,834,613 | A | 5/1989 | Hansen et al. | |
| 4,995,786 | A | 2/1991 | Wheeler et al. | |
| 5,421,703 | A | 6/1995 | Payling | |
| 5,796,199 | A | 8/1998 | Charbonnel | |
| 6,474,941 | B2 | 11/2002 | Dingwell et al. | |
| 6,682,299 | B2 | 1/2004 | Bowen et al. | |
| 6,767,183 | B2 | 7/2004 | Schilling et al. | |
| 7,121,727 | B2 | 10/2006 | Bruce et al. | |
| 7,445,427 | B2 | 11/2008 | Gutknecht et al. | |
| 7,510,369 | B2 | 3/2009 | Lytle | |
| 7,588,416 | B2 | 9/2009 | Bouru | |
| 7,670,106 | B2 | 3/2010 | Bouru | |
| 7,966,806 | B2 | 6/2011 | Henry et al. | |
| 8,007,229 | B2 | 8/2011 | McCaffrey et al. | |
| 8,105,019 | B2 | 1/2012 | McCaffrey et al. | |

(Continued)

*Primary Examiner* — David Hamaoui
*Assistant Examiner* — Brian O Peters
(74) *Attorney, Agent, or Firm* — Getz Balich LLC

(57) ABSTRACT

A variable area vane arrangement includes a stator vane, a bushing and a vane platform with an aperture. The stator vane rotates about an axis, and includes a shaft that extends along the axis into the aperture. The bushing is connected to the shaft, and is arranged within the aperture between the vane platform and the shaft.

15 Claims, 10 Drawing Sheets

(56) References Cited

U.S. PATENT DOCUMENTS

| | | | |
|---|---|---|---|
| 8,328,512 | B2 | 12/2012 | Major et al. |
| 9,347,327 | B2 | 5/2016 | Armstrong et al. |
| 2004/0120618 | A1 | 6/2004 | Bruce et al. |
| 2008/0206045 | A1 | 8/2008 | Foucher |
| 2011/0300779 | A1 | 12/2011 | Talarico et al. |
| 2012/0257963 | A1 | 10/2012 | Major et al. |
| 2013/0195651 | A1 | 8/2013 | Dube et al. |

* cited by examiner

BUSHING ARRANGED BETWEEN A BODY AND A SHAFT, AND CONNECTED TO THE SHAFT

CROSS-REFERENCE TO RELATED APPLICATIONS

This application claims priority to and is a divisional of U.S. patent application Ser. No. 14/107,719 filed Dec. 16, 2013, which claims priority to U.S. Provisional Appln. No. 61/765,439 filed Feb. 15, 2013. The '719 and '439 applications are hereby incorporated herein by reference in their entireties.

This invention was made with government support under Contract No. N00019-02-C-3003 awarded by the United States Navy. The government may have certain rights in the invention.

BACKGROUND OF THE INVENTION

1. Technical Field

This disclosure relates generally to bushings and, more particularly, to a bushing that reduces wear between a shaft and a body of, for example, a variable area vane arrangement for a turbine engine.

2. Background Information

A typical turbine engine includes a plurality of engine sections such as, for example, a fan section, a compressor section, a combustor section and a turbine section. The turbine engine may also include a variable area vane arrangement. Such a vane arrangement may be configured to guide and/or adjust the flow of gas through a respective one of the engine sections. Alternatively, the vane arrangement may be configured to guide and/or adjust the flow of gas between adjacent engine sections.

A typical variable area vane arrangement includes a plurality of adjustable stator vanes. Each of the stator vanes includes an airfoil that extends between an outer vane platform and an inner vane platform. Each of the stator vanes also includes an outer shaft and an inner shaft. The outer shaft is rotatably connected to the outer vane platform. The inner shaft is rotatably connected to the inner vane platform. A floating inner bushing may be arranged between the inner shaft and the inner vane platform. A floating outer bushing may be arranged between the outer shaft and the outer vane platform. Such floating bushings may rub against and therefore wear both the shafts and vane platforms.

SUMMARY OF THE DISCLOSURE

According to an aspect of the invention, a variable area vane arrangement is provided that includes a stator vane, a bushing, and a vane platform with an aperture. The stator vane rotates about an axis, and includes a shaft that extends along the axis into the aperture. The bushing is connected to the shaft, and arranged within the aperture between the vane platform and the shaft.

According to another aspect of the invention, another variable area vane arrangement is provided that includes a stator vane, a bushing, and a vane platform with an aperture. The stator vane rotates about an axis, and includes a shaft that extends along the axis into the aperture. The bushing is connected to the shaft, and separates the vane platform from the shaft.

According to still another aspect of the invention, a turbine engine is provided that includes a shaft, a bushing, and a turbine engine body with an aperture. The shaft rotates about an axis, and extends along the axis into the aperture. The bushing is connected to the shaft, and arranged within the aperture between the body and the shaft.

The bushing may be press fit onto the shaft.

The bushing may be mechanically fastened to the shaft. For example, an anti-rotation element may connect the bushing to the shaft. The bushing may include an inner flange that engages a distal end of the shaft. The anti-rotation element may be a fastener that (e.g., fixedly) connects the flange to the shaft.

The bushing may be bonded (e.g., welded, brazed or otherwise adhered) to the shaft.

The bushing may include a coated outer bearing surface that engages the vane platform.

A second bushing may be arranged within the aperture between the vane platform and the bushing. This second bushing may be (e.g., fixedly) connected to the vane platform.

The vane platform may extend circumferentially around a second axis. The shaft may extend into the aperture in a radial inward direction relative to the second axis.

The vane platform and a second vane platform may form a gas path. The stator vane may include an airfoil that rotates about the axis within the gas path.

The aperture may be one of a plurality of apertures included in the vane platform. The stator vane may be one of a plurality of stator vanes. Each of the stator vanes may include a shaft that rotates about a respective axis, and extends into a respective one of the apertures along the respective axis. The bushing may be one of a plurality of bushings that are respectively arranged within the apertures between the vane platform and the respective shafts. Each of the bushings may be connected to a respective one of the shafts.

A plurality of engine sections may be included that are arranged along a second axis. The engine sections may include a compressor section, a combustor section and/or a turbine section. A variable area vane arrangement may be included that directs gas (e.g., into or through) for one of the engine sections. The vane arrangement may include a vane platform, a stator vane and the bushing. The vane platform may include the body, and the stator vane may include the shaft. The engine sections may also include a fan section, where the vane arrangement directs gas for the fan section. A gear train may be included that connects a rotor in a first of the engine sections to a rotor in a second of the engine sections.

According to an aspect of the invention, a variable area vane arrangement is provided that includes a vane platform, a stator vane, and a bushing that is fixedly connected to the vane platform. The vane platform includes an aperture having a depth that extends along an axis. The stator vane rotates about the axis, and includes a shaft that extends along the axis into the aperture. The bushing is arranged within the aperture between the vane platform and the shaft. The bushing has a length that extends along the axis and is substantially equal to or less than the depth.

According to another aspect of the invention, another variable area vane arrangement is provided that includes a vane platform, a stator vane, and a bushing. The vane platform includes an aperture having a depth that extends along an axis. The stator vane rotates about the axis, and includes a shaft that extends along the axis into the aperture. The bushing is arranged within the aperture between the vane platform and the shaft, and is axially retained and rotatably constrained within the aperture. The bushing has a length that extends along the axis and is substantially equal to or less than the depth.

According to still another aspect of the invention, a turbine engine is provided that includes a turbine engine body, a shaft, and a bushing that is fixedly connected to the body. The body includes an aperture having a depth that extends along an axis into the body. The shaft rotates about the axis, and extends along the axis into the aperture. The bushing is arranged within the aperture between the body and the shaft. The bushing has a length that extends along the axis and is substantially equal to or less than the depth.

The aperture may extend into the vane platform from a (e.g., inner or outer) platform side. The bushing may be recessed into the vane platform from the platform side by a distance along the axis.

The aperture may extend within the vane platform to a shelf. The bushing may extend along the axis between opposing bushing ends. A first of the bushing ends may engage the shelf.

The bushing may be press fit into the vane platform. The bushing may also or alternatively be bonded to the vane platform. The bushing may also or alternatively be mechanically fastened to the vane platform. For example, an element such as a fastener, key, protrusion, compression sleeve, ring, etc. may axially retain and/or rotatably constrain the bushing within the aperture.

A second aperture may extend (e.g., radially or axially) into the vane platform from the aperture. The bushing may include a sleeve. The element may extend into the second aperture from the sleeve.

The vane platform may include a first platform segment with a first mate face, and a second platform segment with a second mate face that engages (e.g., contacts) the first mate face. The aperture may extend into the first and the second platform segments. The element may extend into the first and/or the second platform segments. For example, at least a portion of the second aperture may extend into the first platform segment from the first mate face.

The second aperture and/or the element may each have an arcuate (e.g., crescent, semi-annular, etc.) cross-sectional geometry. Alternatively, the second aperture and/or the element may each have a polygonal (e.g., square, rectangular, triangular, etc.) cross-sectional geometry.

The element may include a compression sleeve (e.g., an elastic polymer sleeve) arranged within the aperture between the vane platform and the bushing.

The element may include a fastener (e.g., a pin, bolt, etc.) that extends from the vane platform into the bushing.

The element may include an annular ring that extends into the vane platform and the bushing.

A second bushing may be arranged within the aperture between the bushing and the shaft. The second bushing may be connected to the shaft.

The vane platform may extend circumferentially around a second axis. The shaft may extend into the aperture in a radial inwards or outwards direction relative to the second axis.

A plurality of engine sections may be included that are arranged along a second axis. The engine sections may include a compressor section, a combustor section and a turbine section. A variable area vane arrangement may be included that directs gas for (e.g., into or through) one of the engine sections. The vane arrangement may include a vane platform, a stator vane and the bushing. The vane platform may include the body, and the stator vane may include the shaft. The engine sections may also include a fan section, where the variable area vane arrangement directs gas for the fan section. A gear train may be included that connects a rotor in a first of the engine sections to a rotor in a second of the engine sections.

The foregoing features and the operation of the invention will become more apparent in light of the following description and the accompanying drawings.

DETAILED DESCRIPTION OF THE INVENTION

Figure 1:
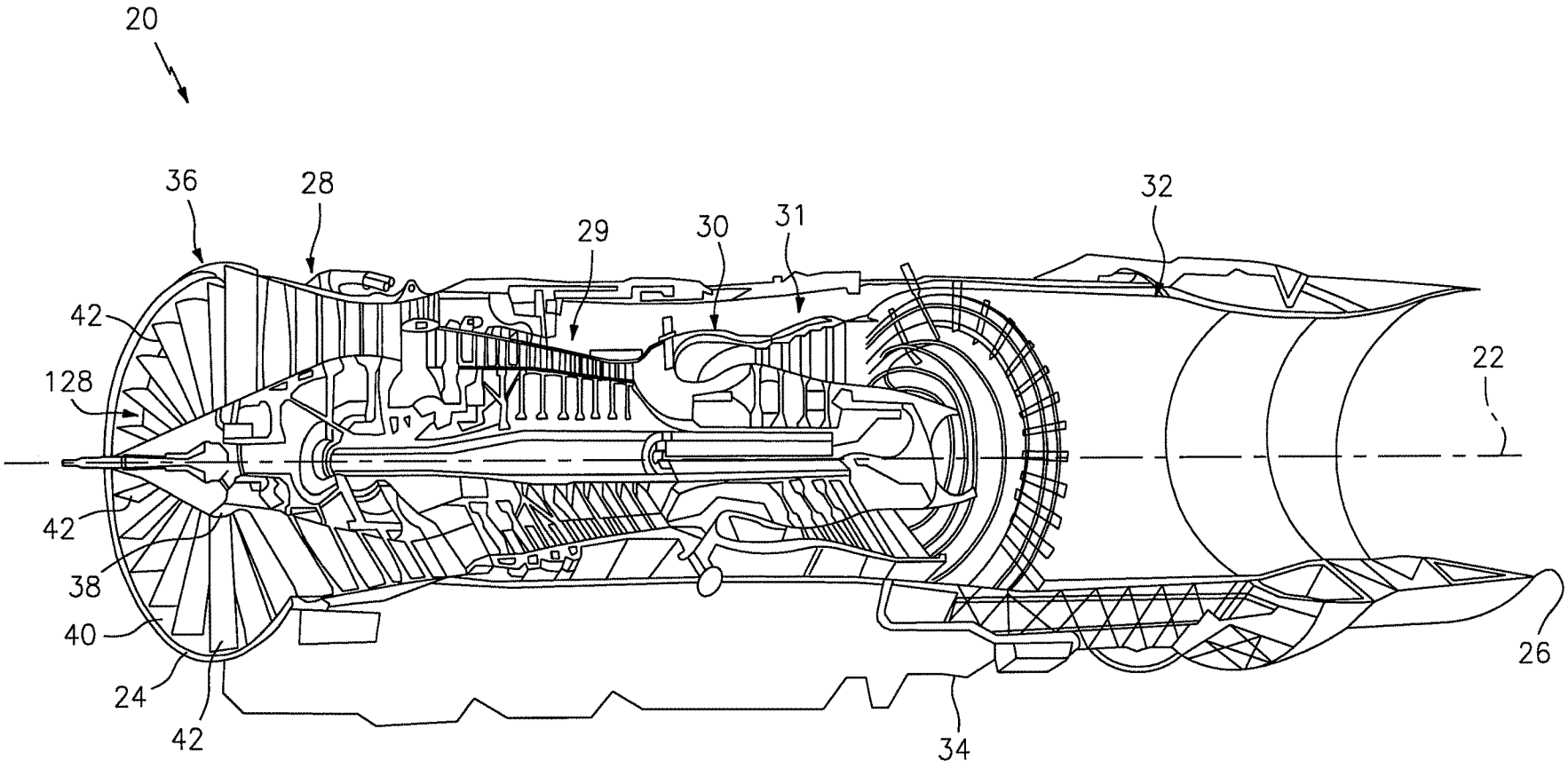
FIG. 1 is a side cutaway illustration of a turbine engine.

FIG. 1 is a side cutaway illustration of a turbine engine 20 that extends along a first axis 22 between a forward airflow inlet 24 and an aft airflow exhaust 26. The engine 20 includes a fan section 28, a compressor section 29, a combustor section 30, a turbine section 31 and a nozzle section 32. These engine sections 28-32 are arranged sequentially along the first axis 22 and housed within an engine case 34.

Figure 2:
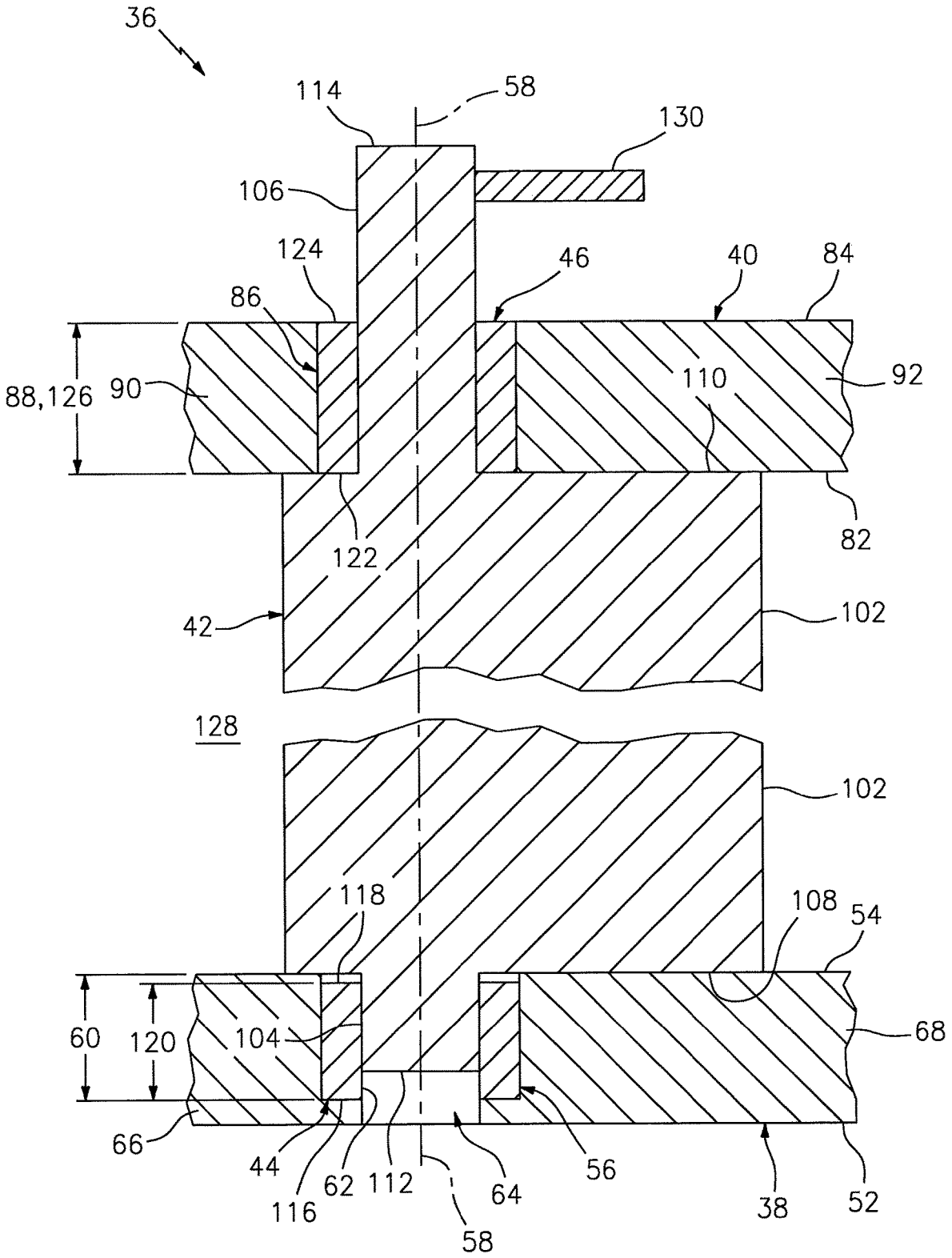
FIG. 2 is a partial, side sectional illustration of a variable area vane arrangement.

The engine 20 also includes at least one variable area vane arrangement 36 for directing gas for one of the engine sections 28-32; e.g., guiding and/or adjusting flow of air into (or through) the fan section 28. Referring to FIG. 2, the variable area vane arrangement 36 includes an inner vane platform 38, an outer vane platform 40, one or more adjustable stator vanes 42, and one or more bushings; e.g., inner bushings 44 and outer bushings 46. In one embodiment, the vane platforms 38 and 40 may be annular. In addition, the variable area vane arrangement 36 may also include one or more fixed stator vanes (not shown).

Figure 3:
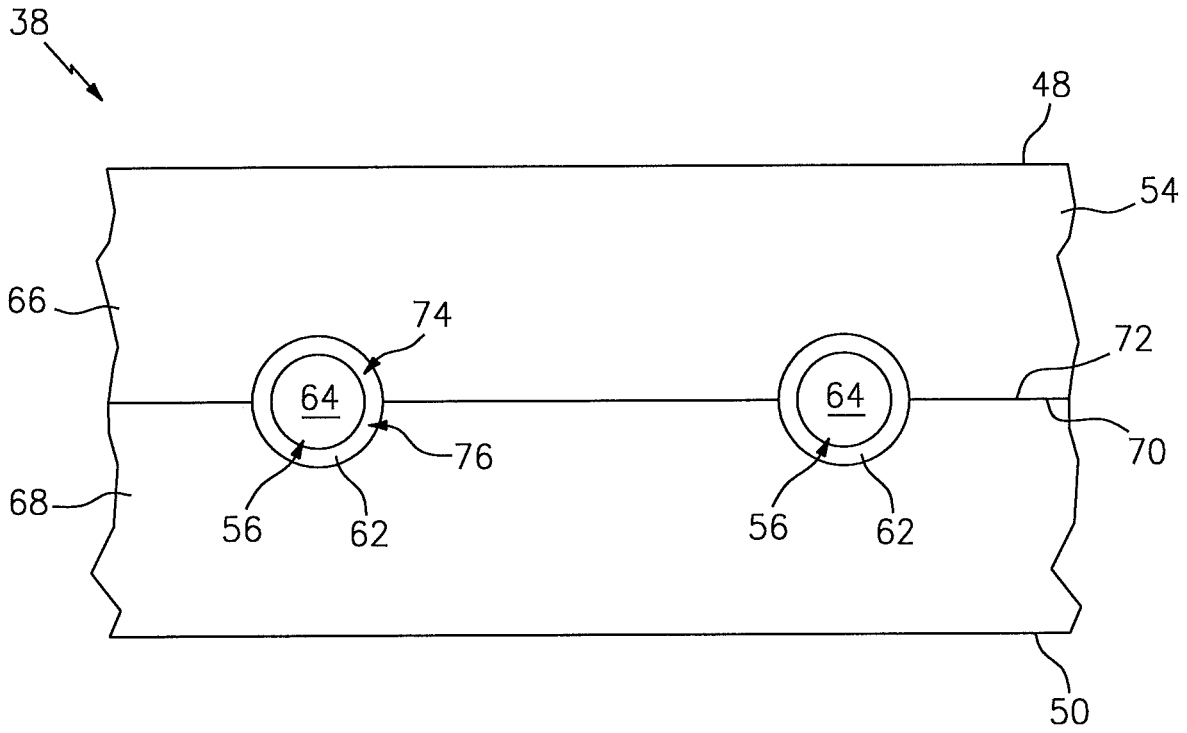
FIG. 3 is a partial illustration of an outer side of an inner vane platform for the vane arrangement of FIG. 2.

Referring to FIG. 1, the inner vane platform 38 extends circumferentially around the first axis 22. Referring now to FIGS. 2 and 3, the inner vane platform 38 extends axially, relative to the first axis 22, between a forward platform end 48 and an aft platform end 50. The inner vane platform 38 extends radially, relative to the first axis 22, between an inner platform side 52 and an outer platform side 54. The inner vane platform 38 includes one or more apertures 56, which are circumferentially arranged about the first axis 22. Each of the apertures 56 extends along a respective second axis 58 at least partially into the inner vane platform 38, which defines an aperture depth 60. For example, each of the apertures 56 extends radially inward, relative to the first axis 22, into the inner vane platform 38 from the outer platform side 54 to a (e.g., annular) shoulder 62. A vent 64 or any other type of aperture may extend through the inner vane platform 38 from the aperture 56 and shoulder 62 to the inner platform side 52.

The inner vane platform 38 may also include a plurality of discrete (e.g., annular) axial platform segments 66 and 68. The first platform segment 66 extends axially, relative to the first axis 22, from the forward platform end 48 to a first mate face 70. The second platform segment 68 extends axially, relative to the first axis 22, from the aft platform end 50 to a second mate face 72. The first platform segment 66 is connected to the second platform segment 68, and the first mate face 70 engages (e.g., contacts) the second mate face 72. Each of the apertures 56 may extend into both the first and the second platform segments 66 and 68. The first platform segment 66, for example, includes forward portions 74 of the apertures 56 and the second platform segment 68 includes aft portions 76 of the apertures 56.

Figure 4:
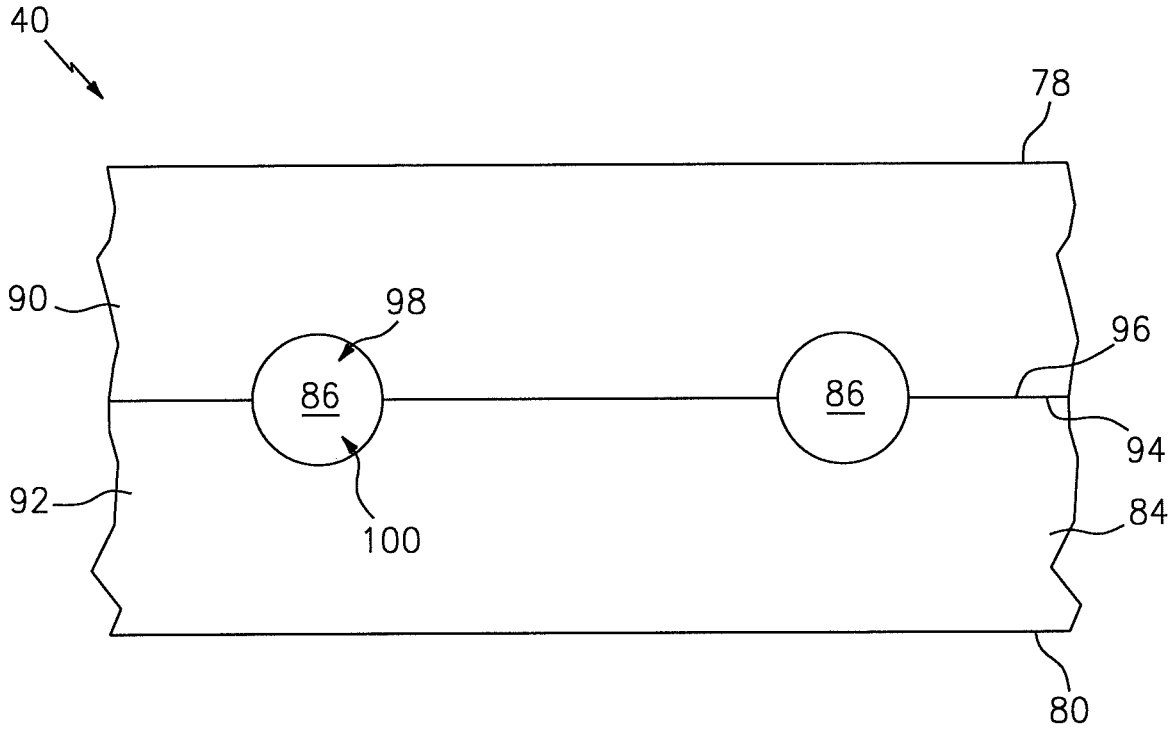
FIG. 4 is a partial illustration of an outer side of an outer vane platform for the vane arrangement of FIG. 2.

Referring to FIG. 1, the outer vane platform 40 extends circumferentially around the first axis 22. Referring now to FIGS. 2 and 4, the outer vane platform 40 extends axially, relative to the first axis 22, between a forward platform end 78 and an aft platform end 80. The outer vane platform 40 extends radially, relative to the first axis 22, between an inner platform side 82 and an outer platform side 84. The outer vane platform 40 includes one or more apertures 86 that are circumferentially arranged about the first axis 22. Each of the apertures 86 may extend along the respective second axis 58 at least partially into the outer vane platform 40, which defines an aperture depth 88. For example, each of the apertures 86 extends radially, relative to the first axis 22, through the outer vane platform 40 between the inner and the outer platform sides 82 and 84.

The outer vane platform 40 may also include a plurality of discrete (e.g., annular) axial platform segments 90 and 92. The first platform segment 90 extends axially, relative to the first axis 22, from the forward platform end 78 to a first mate face 94. The second platform segment 92 extends axially, relative to the first axis 22, from the aft platform end 80 to a second mate face 96. The first platform segment 90 is connected to the second platform segment 92, and the first mate face 94 engages the second mate face 96. Each of the apertures 86 may extend into both the first and the second platform segments 90 and 92. The first platform segment 90, for example, includes forward portions 98 of the apertures 86 and the second platform segment 92 includes aft portions 100 of the apertures 86.

Referring to FIG. 2, each of the adjustable stator vanes 42 includes an airfoil 102 and one or more shafts; e.g., an inner shaft 104 and an outer shaft 106. The airfoil 102 extends radially, relative to the first axis 22, between an inner airfoil end 108 and an outer airfoil end 110. The inner shaft 104 extends along the respective second axis 58 from the inner airfoil end 108 to an inner vane end 112. The outer shaft 106 extends along the respective second axis 58 from the outer airfoil end 110 to an outer vane end 114.

Each of the inner bushings 44 and/or the outer bushings 46 may be configured as an annular sleeve, and extend circumferentially around the respective second axis 58. One or more of the inner bushings 44 each extends axially, relative to the respective second axis 58, between opposing bushing ends 116 and 118, which defines a bushing length 120. This bushing length 120 may be less than (or substantially equal to or greater than) the aperture depth 60. One or more of the outer bushings 46 each extends axially, relative to the respective second axis 58, between opposing bushing ends 122 and 124, which defines a bushing length 126. This bushing length 126 may be substantially equal to (or less or greater than) the aperture depth 88. One or more of the inner and/or outer bushings 44 and 46 may have a unitary body, or alternatively may be configured as a split bushing. One or more of the inner and/or outer bushings 44 and 46 may be constructed from materials such as metal, polymer, etc.

Referring to FIG. 1, the inner vane platform 38 is arranged radially within the outer vane platform 40, which forms a (e.g., annular) gas path 128 therebetween. The adjustable stator vanes 42 are arranged circumferentially around the first axis 22, and rotatably connected to the inner and/or the outer vane platforms 38 and 40. Referring to FIG. 2, each airfoil 102 extends through the gas path 128. The inner airfoil end 108 is located adjacent the outer platform side 54, and the outer airfoil end 110 is located adjacent the inner platform side 82. Each inner shaft 104 extends into the respective aperture 56. Each outer shaft 106 extends through the respective aperture 86, and may be connected to a control arm 130 at (e.g., adjacent, proximate or on) the outer vane end 114. Each inner bushing 44 is arranged within the respective aperture 56 between the inner vane platform 38 and the respective inner shaft 104. The inner bushing end 116 is located adjacent and may engage the respective shelf 62. The outer bushing end 118 may be recessed from (or flush with) the outer platform side 54 by a distance along the axis 58. Each outer bushing 46 is arranged within the respective aperture 86 between the outer vane platform 40 and the respective outer shaft 106. The inner bushing end 122 may be flush with (or recessed from) the inner platform side 82. The outer bushing end 124 may be flush with (or recessed from) the outer platform side 84. These bushings 44 and 46 respectively provide buffers between the vane platforms 38 and 40 and the shafts 104 and 106.

One or more of the inner bushings 44 may be respectively fixedly connected to the inner shafts 104 or the inner vane platform 38. The inner bushings 44, for example, may be respectively press fit onto/into, bonded (e.g., welded, brazed or otherwise adhered) to and/or mechanically fastened to the inner shafts 104 or the inner vane platform 38. Such "fixed connections" may substantially prevent the inner bushings 44 from respectively moving along or rotating about the second axes 58. Fixed connections between the inner bushings 44 and the inner shafts 104 may substantially prevent sliding between the bushings 44 and shafts 104. These bushings 44 therefore may reduce or prevent frictional wear to the shafts 104. Each inner bushing 44 also increases the affective outer surface area of the respective inner shaft 104 and therefore distributes loads between the inner vane platform 38 and the shaft 104 over a greater area. Fixed connections between the inner bushings 44 and the inner vane platform 38 may substantially prevent sliding between the bushings 44 and platform 38. These bushings 44 therefore may reduce or prevent frictional wear to the platform 38. Thus, the inner bushings 44 may be replaced during maintenance rather than replacing or refurbishing the adjustable stator vanes 42 or the inner vane platform 38.

Alternatively, one or more of the inner bushings 44 may be respectively connected to the inner shafts 104 or the inner vane platform 38 in a manner that constrains movement of the bushings 44 about and/or constrains movement of the bushings 44 along the second axes 58. The inner bushings 44, for example, may be axially retained within the apertures 56, and constrained from rotating more than between zero and about plus or minus (+/−) six degrees about the respective second axes 58.

One or more of the outer bushings 46 may be respectively fixedly connected to the outer shafts 106 or the outer vane platform 40. The outer bushings 46, for example, may be respectively press fit onto/into, bonded to and/or mechanically fastened to the outer shafts 106 or the outer vane platform 40. Such "fixed connections" may substantially prevent the outer bushings 46 from respectively moving along or rotating about the second axes 58. Fixed connections between the outer bushings 46 and the outer shafts 106 may substantially prevent sliding between the bushings 46 and the shafts 106. These bushings 46 therefore may reduce or prevent frictional wear to the shafts 106. Each outer bushing 46 also increases the affective outer surface area of the respective outer shaft 106 and therefore distributes loads between the outer vane platform 40 and the shaft 106 over a greater area. Fixed connections between the outer bushings 46 and the outer vane platform 40 may substantially prevent sliding between the bushings 46 and platform 40. These bushings 46 therefore may reduce or prevent frictional wear to the platform 40. Thus, the outer bushings 46 may be replaced during maintenance rather than replacing or refurbishing the adjustable stator vanes 42 or the outer vane platform 40.

Alternatively, one or more of the outer bushings 46 may be respectively connected to the outer shafts 106 or the outer vane platform 40 in a manner that constrains movement of the bushings 46 about and/or constrains movement of the bushings 46 along the respective second axes 58. The outer bushings 46, for example, may be axially retained within the apertures 86, and constrained from rotating more than between zero and about plus or minus six degrees about the respective second axes 58.

Figure 5:
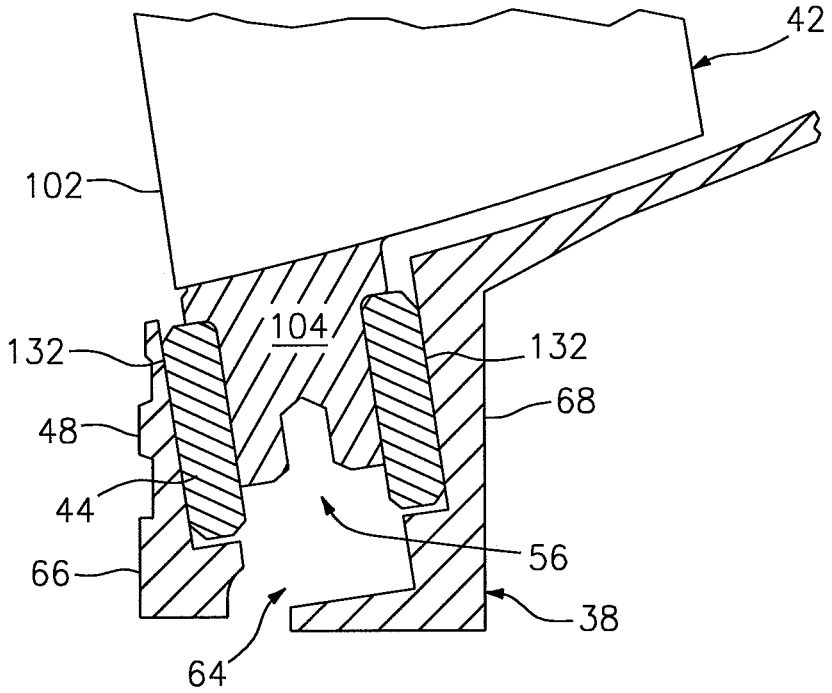
FIG. 5 is a partial, sectional illustration of an alternate variable area vane arrangement.

One or more of the inner and/or outer bushings 44 and 46 may each include a coated bearing surface that slidably engages another body, such as the respective shaft or vane platform. In the embodiment of FIG. 5, for example, each of the inner bushings 44 is connected to the respective inner shaft 104. Each of the inner bushings 44 includes a coated bearing surface 132 that slidably engages the inner vane platform 38. The coating may be a hard coating that reduces wear to the inner vane platform 38 and/or to the bushings 44. Such a hard coating may include one or more of the following materials: chromium, tungsten, cobalt, chromium carbide, tungsten carbide, nickel, copper and/or aluminum. The present invention, however, is not limited to any particular hard coating materials or types of coatings.

Figure 6:
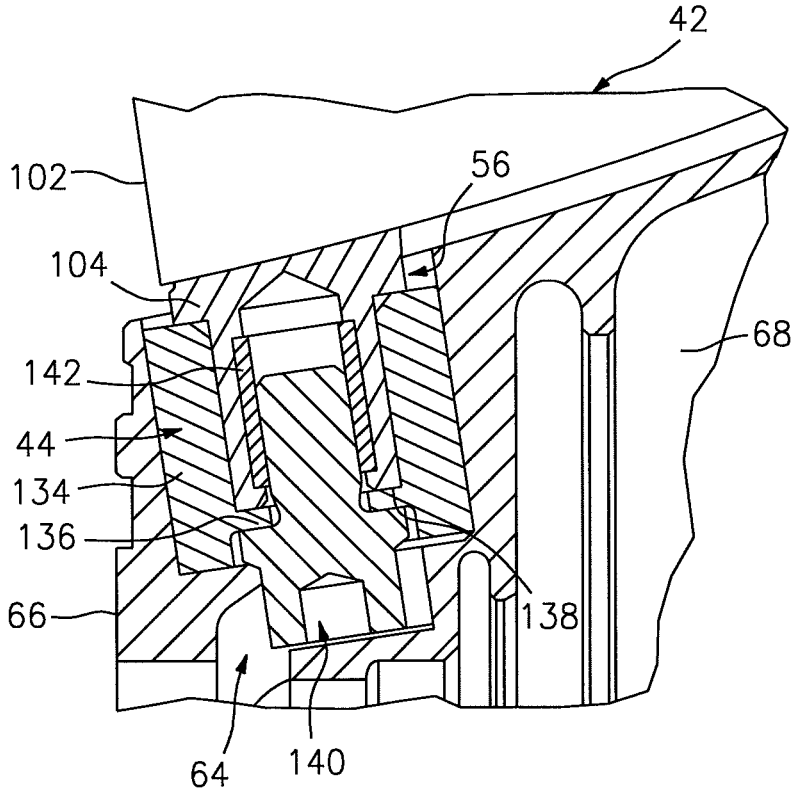
FIG. 6 is a partial, sectional illustration of another alternate variable area vane arrangement.

One or more of the inner and/or outer bushings 44 and 46 may be respectively (e.g., fixedly) connected to the shafts 104 and 106 with anti-rotation and/or axial retainment elements such as fasteners (e.g., bolts or pins), keys, protrusions or compression sleeves. In some embodiments, for example as illustrated in FIG. 6, one or more of the inner bushings 44 each includes an annular sleeve 134 and an annular inner flange 136. The inner shaft 104 extends axially through the sleeve 134, and a distal end 138 of the inner shaft 104 engages the flange 136. A fastener 140 extends through a bore of the flange 136 and into the inner shaft 104. The fastener 140 clamps the flange 136 against the distal end 138, thereby axially and/or rotatably constraining movement of the bushing 44. The shaft 104 may include a threaded insert 142 to receive the fastener 140 where, for example, the shaft 104 is made from a relatively soft material such as aluminum or aluminum alloy.

Figure 7:
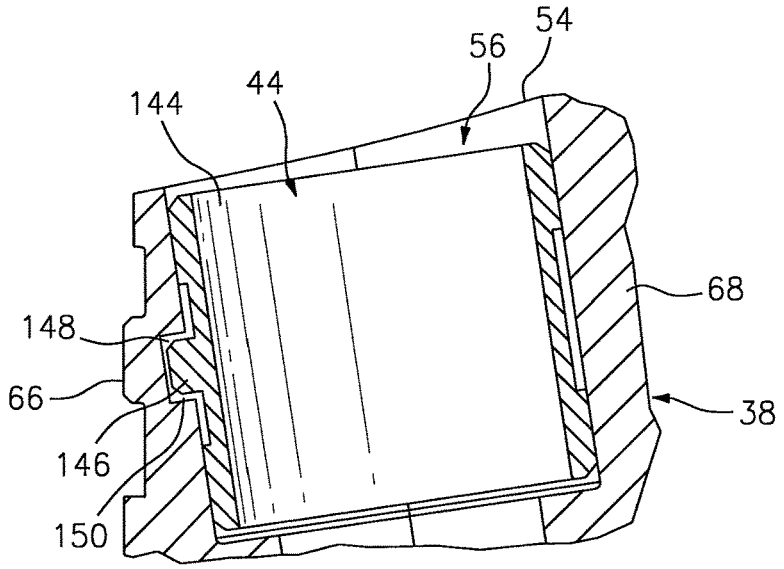
FIG. 7 is a partial, sectional illustration of a bushing arranged within an aperture of a vane platform.
Figure 8:
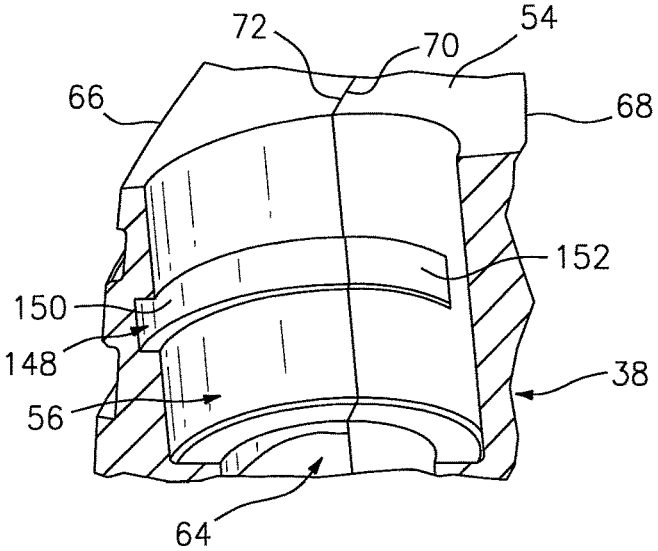
FIG. 8 is a perspective, sectional illustration of the aperture and vane platform of FIG. 7.
Figure 9:
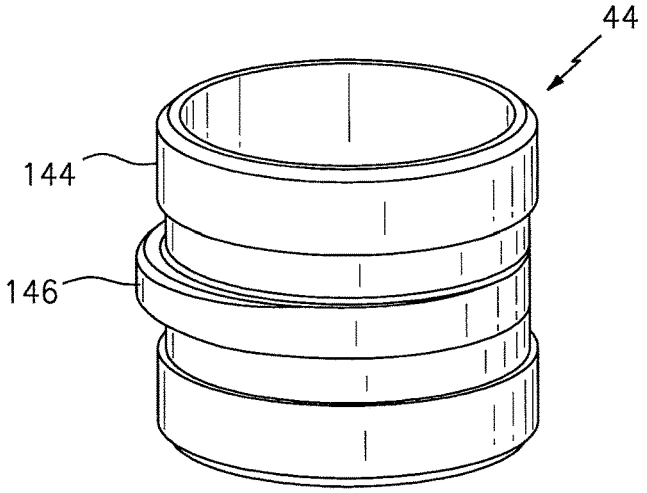
FIG. 9 is a perspective illustration of the bushing of FIG. 7.
Figure 10:
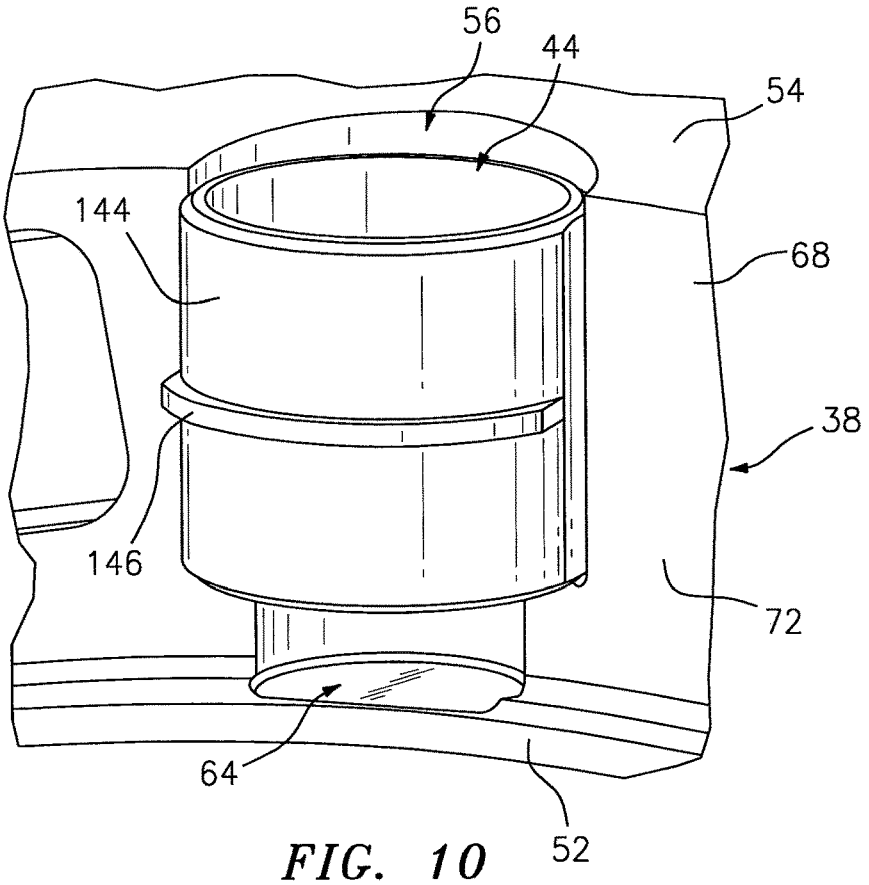
FIG. 10 is a partial, perspective illustration of an alternate bushing arranged within an aperture of an axial platform segment.
Figure 11:
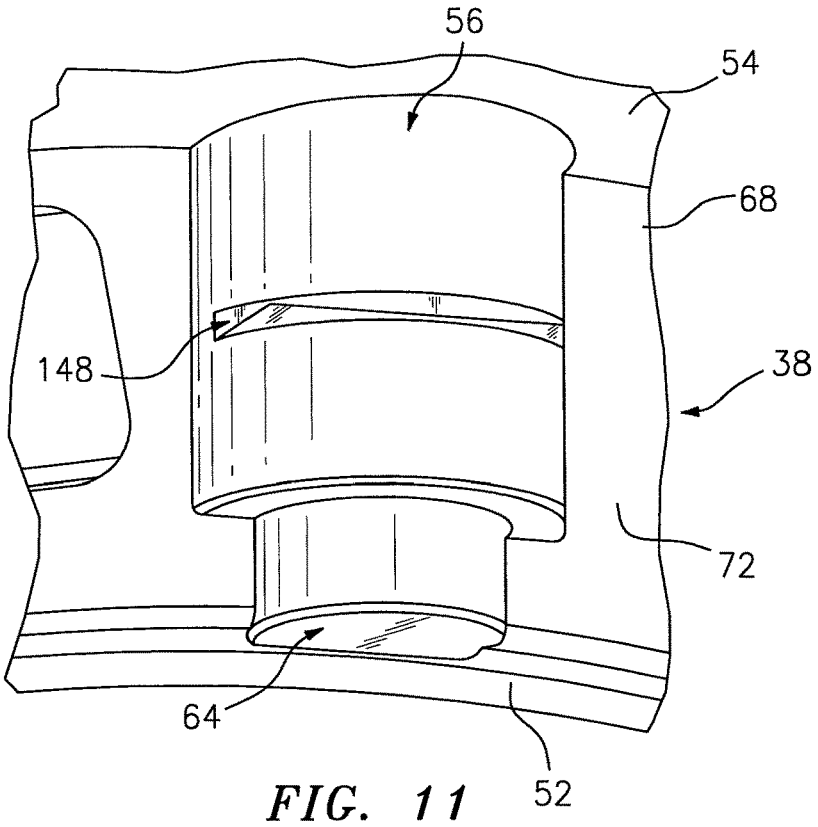
FIG. 11 is a perspective illustration of the aperture and platform segment of FIG. 10.
Figure 12:
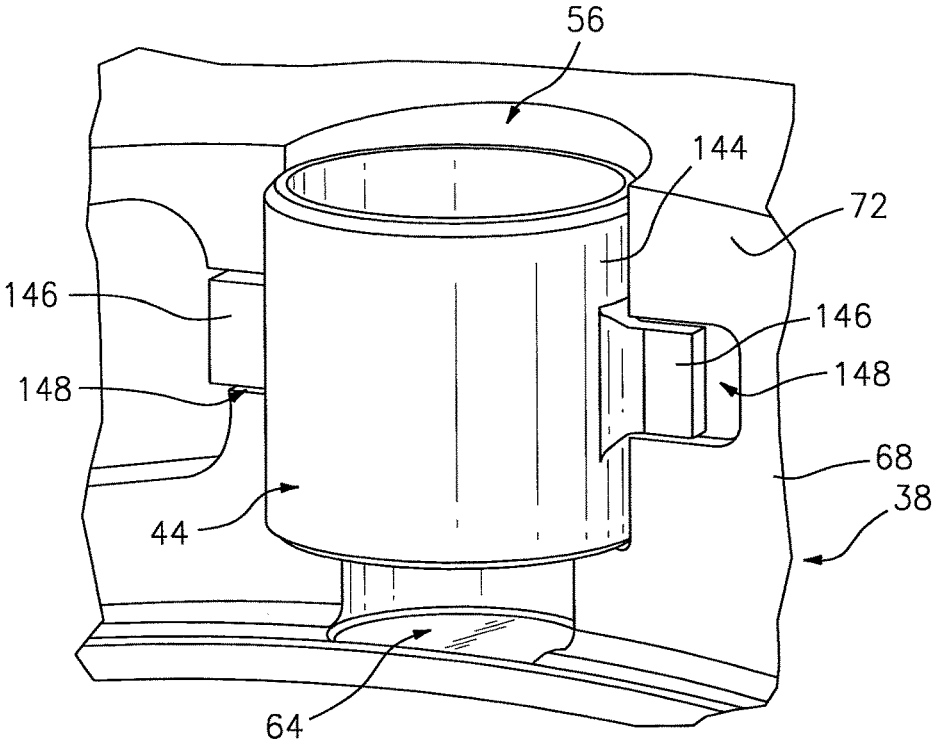
FIG. 12 is a partial, perspective illustration of another alternate bushing arranged within an aperture of an axial platform segment.
Figure 13:
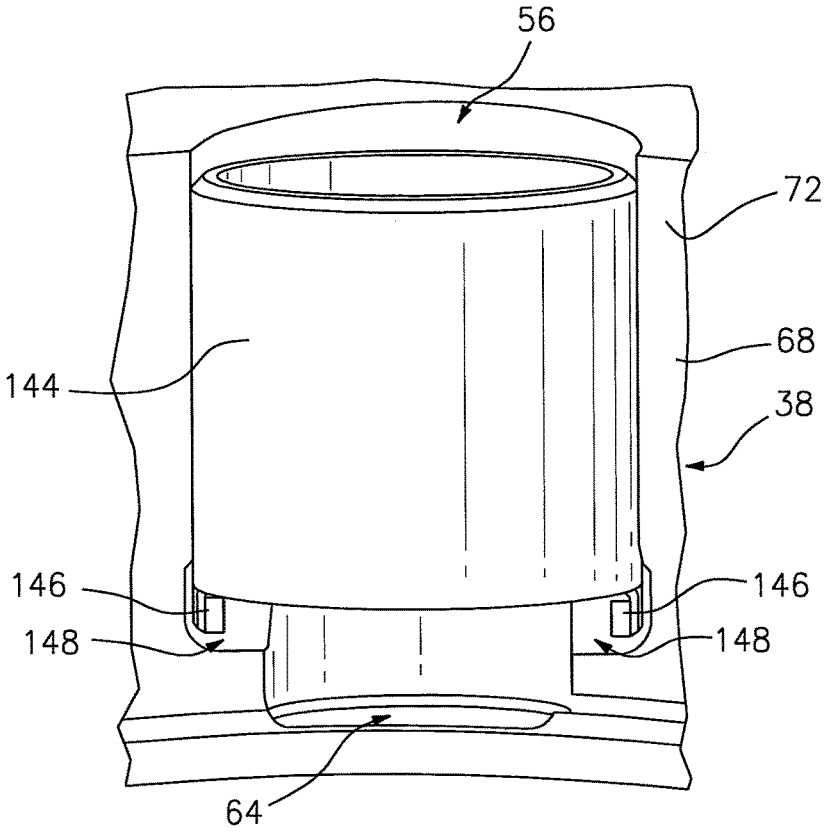
FIG. 13 is a partial, perspective illustration of another alternate bushing arranged within an aperture of an axial platform segment.

One or more of the inner and/or outer bushings 44 and 46 may be respectively (e.g., fixedly) connected to the vane platforms 38 and 40 with anti-rotation and/or axial retainment elements such as fasteners, keys, protrusions or compression sleeves. In some embodiments, for example as illustrated in FIGS. 7-13, one or more of the inner bushings 44 each includes an annular sleeve 144 and one or more protrusions 146. These protrusions 146 extend into respective apertures 148 in the inner vane platform 38. The protrusions 146 therefore axially and/or rotatably constrain movement of the bushing 44. One or more of the protrusions 146 may respectively extend radially from the sleeve into the apertures 148 as illustrated in FIGS. 7 and 12. Alternatively, one or more of the protrusions 146 may respectively extend axially from the sleeve into the apertures 148 as illustrated in FIG. 13. Referring to FIGS. 7 and 8, a portion 150 of each aperture 148 may extend into the first platform segment 66 from the first mate face 70 and/or the respective aperture 56. Referring to FIG. 8, a portion 152 of each aperture 148 may extend into the second platform segment 68 from the second mate face 72 and/or the respective aperture 56. Referring to FIGS. 8-11, one or more of the protrusions 146 and/or one or more of the apertures 148 may each have an arcuate (e.g., crescent or semi-annular) cross-sectional geometry. Referring to FIGS. 12 and 13, one or more of the protrusions 146 and/or one or more of the apertures 148 may each have a polygonal (e.g., square, rectangular or triangular) cross-sectional geometry.

Figure 14:
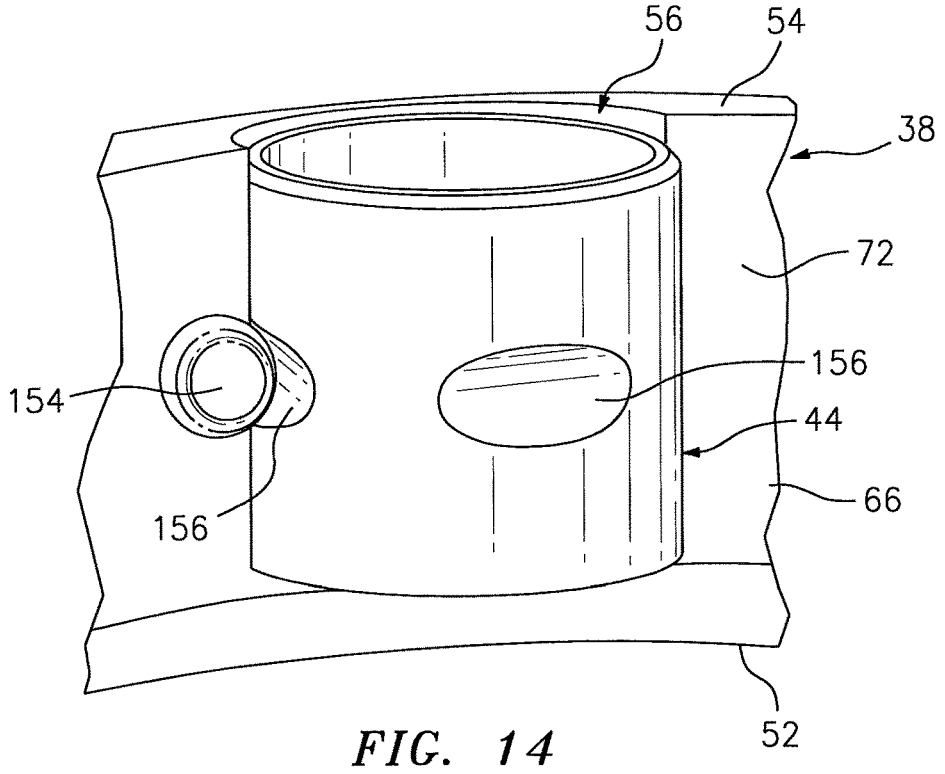
FIG. 14 is a partial, perspective illustration of another alternate bushing arranged within an aperture of an axial platform segment.

In some embodiments, for example as illustrated in FIG. 14, a pin 154 extends through the inner vane platform 38 and into an aperture 156 in the respective inner bushing 44. This pin 154 may therefore axially and/or rotatably constrain movement of the bushing 44.

Figure 15:
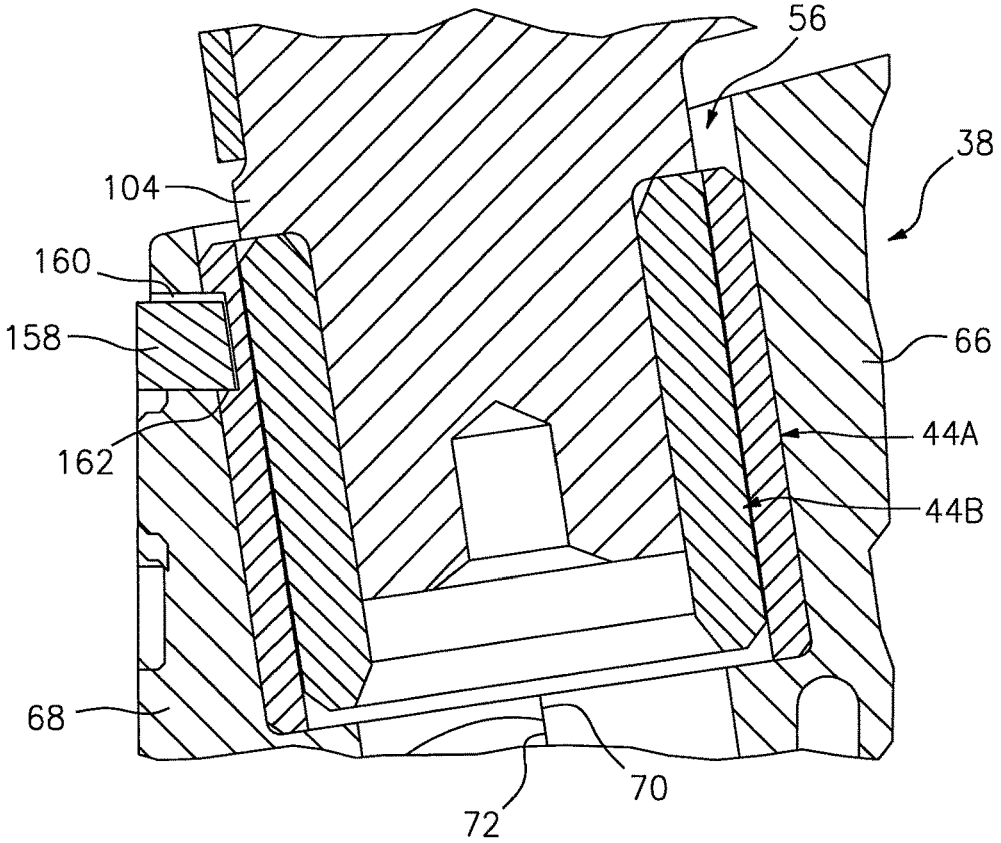
FIG. 15 is a partial, sectional illustration of another alternate variable area vane arrangement.

In some embodiments, for example as illustrated in FIG. 15, an annular ring 158 is seated within a channel 160 in the inner vane platform 38. A portion of the ring 158 extends through the inner vane platform 38 and into an aperture 162 in each respective inner bushing 44A. This ring 158 may therefore axially and/or rotatably constrain movement of the bushing 44A.

Figure 16:
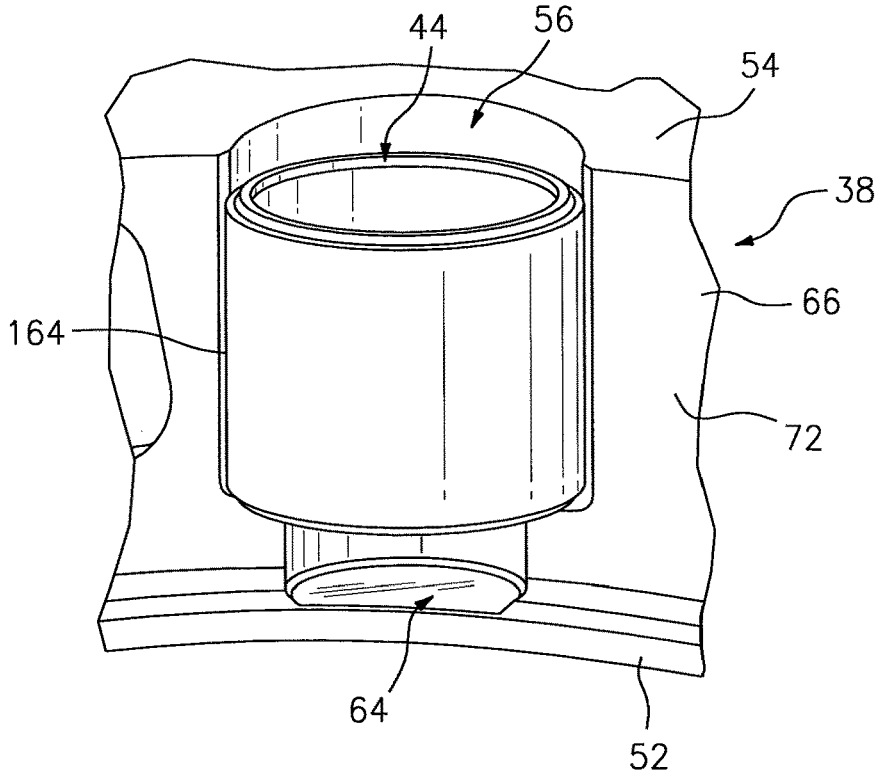
FIG. 16 is a partial, perspective illustration of another alternate bushing arranged within an aperture of an axial platform segment.

In some embodiments, for example as illustrated in FIG. 16, a compression sleeve 164 such as an elastic polymer (e.g., rubber) sleeve is arranged within each aperture 56 between the inner vane platform 38 and the respective inner bushing 44. The compression sleeve 164 may exert a radial force against both the inner vane platform 38 and the respective inner bushing 44. The compression sleeve 164 may therefore axially and/or rotatably constrain movement of the bushing 44.

Figure 17:
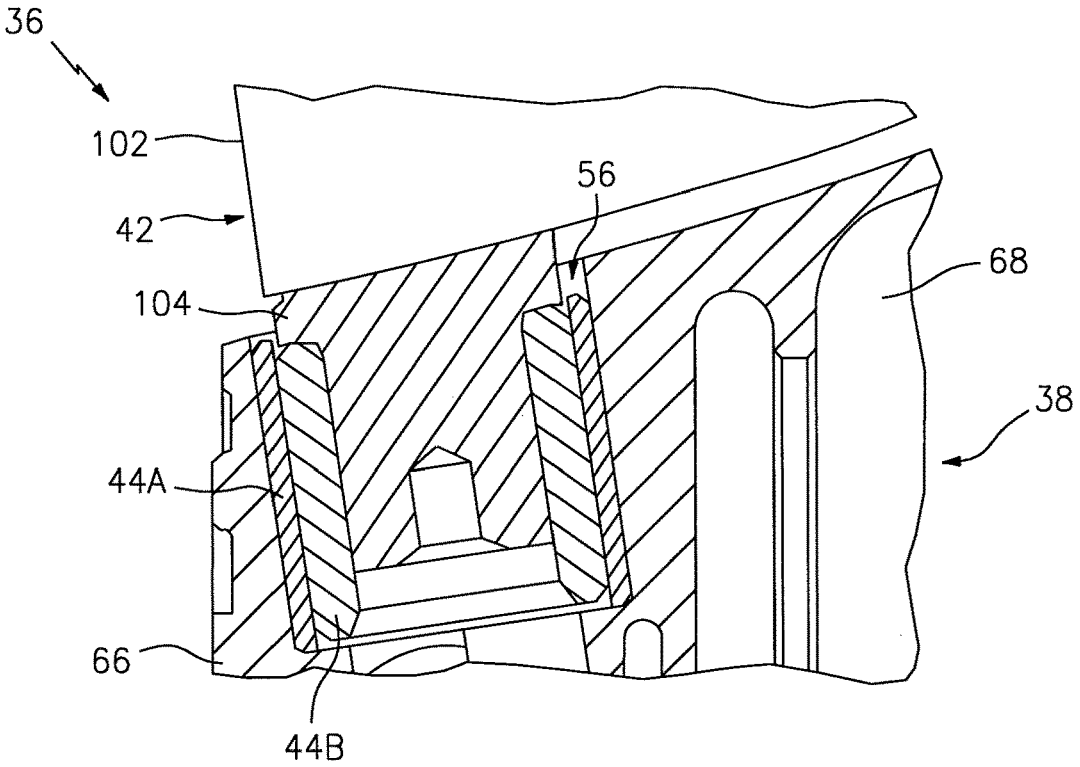
FIG. 17 is a partial, sectional illustration of another alternate variable area vane arrangement.

Referring to FIG. 17, the variable area vane arrangement 36 may include at least one set of first and second inner bushings 44A and 44B. The first inner bushing 44A is (e.g., fixedly) connected to the inner vane platform 38. The second inner bushing 44B is (e.g., fixedly) connected to the inner shaft 104. The first and the second inner bushings 44A and 44B form a journal bearing assembly, which may reduce wear to both the inner shaft 104 and the inner vane platform 38. Similarly, the variable area vane arrangement 36 may include at least one set of first and second outer bushings (not shown).

Figure 18:
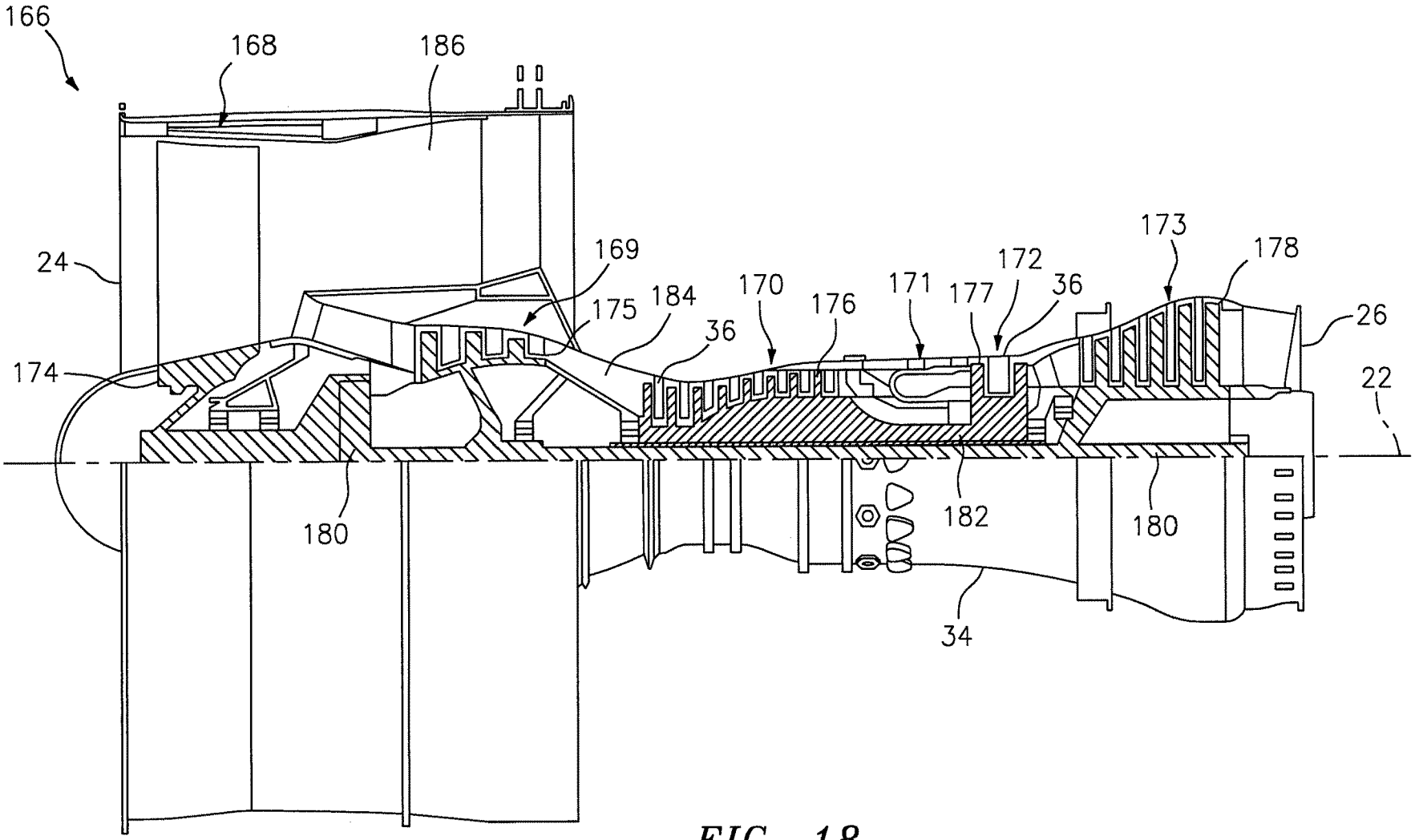
FIG. 18 is a side cutaway illustration of an alternate turbine engine.

The variable area vane arrangement 36 may be included in various turbine engine configurations other than the one described above. One or more of the variable area vane arrangements 36, for example, may be included in a geared turbine engine 166 as illustrated in FIG. 18. The engine 166 includes a fan section 168, a low pressure compressor (LPC) section 169, a high pressure compressor (HPC) section 170, a combustor section 171, a high pressure turbine (HPT) section 172, and a low pressure turbine (LPT) section 173. These engine sections 168-173 are arranged sequentially along an axis 22 and housed within an engine case 34.

Each of the engine sections 168-170, 172 and 173 includes a respective rotor 174-178. Each of the rotors 174-178 includes a plurality of rotor blades arranged circumferentially around and connected (e.g., mechanically fastened, welded, brazed or otherwise adhered) to one or more respective rotor disks. The fan rotor 174 is connected to a gear train 180; e.g., an epicyclic gear train. The gear train 180 and the LPC rotor 175 are connected to and driven by the LPT rotor 178 through a low speed shaft 180. The HPC rotor 176 is connected to and driven by the HPT rotor 177 through a high speed shaft 182. The low and high speed shafts 180 and 182 are rotatably supported by a plurality of bearings. Each of the bearings is connected to the engine case 34 by at least one stator such as, for example, an annular support strut.

Air enters the engine through the airflow inlet 24, and is directed through the fan section 168 and into an annular core gas path 184 and an annular bypass gas path 186. The air within the core gas path 184 may be referred to as "core air". The air within the bypass gas path 186 may be referred to as "bypass air" or "cooling air". The core air is directed through the engine sections 169-173 and exits the engine 166 through the airflow exhaust 26. Within the combustion section 171, fuel is injected into and mixed with the core air and ignited to provide forward engine thrust. The bypass air is directed through the bypass gas path 186 and out of the engine 166 to provide additional forward engine thrust or reverse thrust via a thrust reverser. The bypass air may also be utilized to cool various turbine engine components within one or more of the engine sections 169-173.

The terms "forward", "aft", "inner" and "outer" are used to orientate the components of the variable area vane arrangement 36 described above relative to the turbine engines and their axes. A person of skill in the art will recognize, however, one or more of these components may be utilized in other orientations than those described above. The present invention therefore is not limited to any particular variable area vane arrangement spatial orientations.

A person of skill in the art will recognize the variable area vane arrangement 36 may be included in various types of rotational equipment other than a turbine engine. A person of skill in the art will also recognize one or more of the bushings may be included in devices other than a variable area vane arrangement. The bushings, for example, may be included where a shaft of an actuator is rotatably connected to body such as a case housing internal components of the actuator. The present invention therefore is not limited to any particular types or configurations of rotational equipment or other devices.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A variable area vane arrangement, comprising:

a vane platform including an aperture having a depth that extends along an axis;

a stator vane that rotates about the axis, the stator vane including a shaft that extends along the axis into the aperture;

a bushing fixedly connected to the vane platform, the bushing arranged within the aperture between the vane platform and the shaft, and the bushing having a length that extends along the axis and is one of substantially equal to and less than the depth;

an element that at least one of axially retains and rotatably constrains the bushing within the aperture, the element comprising a fastener that extends from the vane platform into the bushing; and a second bushing that is arranged within the aperture between the bushing and the shaft, and the second bushing is connected to the shaft.

2. The vane arrangement of claim 1, wherein the aperture extends into the vane platform from a platform side; and the bushing is recessed into the vane platform from the platform side by a distance along the axis.

3. The vane arrangement of claim 1, wherein the aperture extends within the vane platform to a shelf;

the bushing extends along the axis between opposing bushing ends; and a first of the bushing ends engages the shelf.

4. The vane arrangement of claim 1, wherein the vane platform extends circumferentially around a second axis; and the shaft extends into the aperture in a radial inward direction relative to the second axis.

5. A turbine engine, comprising:

a plurality of engine sections arranged along a second axis, the engine sections including a compressor section, a combustor section and a turbine section; and the variable area vane arrangement of claim 1, the variable area vane arrangement configured to direct gas for one of the engine sections.

6. The engine of claim 5, wherein the engine sections further include a fan section; and the variable area vane arrangement is configured to direct the gas for the fan section.

7. The engine of claim of claim 5, further comprising a gear train that connects a rotor in a first of the engine sections to a rotor in a second of the engine sections.

8. A variable area vane arrangement, comprising:

a vane platform including an aperture having a depth that extends along an axis;

a stator vane rotatable about the axis, the stator vane including a shaft that extends along the axis into the aperture;

a bushing fixedly connected to the vane platform, the bushing arranged within the aperture between the vane platform and the shaft, and the bushing having a length that extends along the axis and is one of substantially equal to and less than the depth;

an element at least one of axially retaining and rotatably constraining the bushing within the aperture, the element comprising a cylindrical pin that extends from the vane platform into the bushing; and a second bushing arranged within the aperture between the bushing and the shaft, and the second bushing connected to the shaft.

9. The vane arrangement of claim 8, wherein the aperture extends into the vane platform from a platform side; and the bushing is recessed into the vane platform from the platform side by a distance along the axis.

10. The vane arrangement of claim 8, wherein the aperture extends within the vane platform to a shelf;

the bushing extends along the axis between opposing bushing ends; and a first of the bushing ends engages the shelf.

11. The vane arrangement of claim 8, wherein the vane platform extends circumferentially around a second axis; and the shaft extends into the aperture in a radial inward direction relative to the second axis.

12. A variable area vane arrangement, comprising:

a vane platform including an aperture having a depth that extends along an axis;

a stator vane that rotates about the axis, the stator vane including a shaft that extends along the axis into the aperture;

a bushing fixedly connected to the vane platform, the bushing arranged within the aperture between the vane platform and the shaft, and the bushing having a length that extends along the axis and is one of substantially equal to and less than the depth;

an element at least one of axially retaining and rotatably constraining the bushing within the aperture, the element comprising a fastener that extends from the vane platform radially into a notch in the bushing;

wherein the bushing has a tubular sidewall that extends radially between an inner surface and an outer surface, and the notch extends partially radially into, but not through, the tubular sidewall from the outer surface; and a second bushing arranged within the aperture between the bushing and the shaft, and the second bushing connected to the shaft.

13. The vane arrangement of claim 12, wherein the aperture extends into the vane platform from a platform side; and the bushing is recessed into the vane platform from the platform side by a distance along the axis.

14. The vane arrangement of claim 12, wherein the aperture extends within the vane platform to a shelf;

the bushing extends along the axis between opposing bushing ends; and a first of the bushing ends engages the shelf.

15. The vane arrangement of claim 12, wherein the vane platform extends circumferentially around a second axis; and the shaft extends into the aperture in a radial inward direction relative to the second axis.

* * * * *